US008101840B1

(12) United States Patent
Boulanger

(10) Patent No.: US 8,101,840 B1
(45) Date of Patent: Jan. 24, 2012

(54) ERGONOMIC GUITAR STRAP

(76) Inventor: Gary Boulanger, Cedar Crest, NM (US)

( * ) Notice: Subject to any disclaimer, the term of this patent is extended or adjusted under 35 U.S.C. 154(b) by 0 days.

(21) Appl. No.: 12/853,054

(22) Filed: Aug. 9, 2010

(51) Int. Cl.
*G10D 3/00* (2006.01)

(52) U.S. Cl. ..... 84/327; 84/329

(58) Field of Classification Search ..... 84/453, 84/290, 327, 329
See application file for complete search history.

(56) References Cited

U.S. PATENT DOCUMENTS 6,791,018 B2 * 9/2004 Bazata ..... 84/327

* cited by examiner

*Primary Examiner* — Kimberly Lockett
(74) *Attorney, Agent, or Firm* — John Nielsen

(57) ABSTRACT

An ergonomic guitar strap which reduces the load on the shoulder, balances the weight of the guitar front-to-back, absorbs shock during play and isolates motion by the use of a cushioning pad that is constructed with a soft, flexible foam layer which conforms to a user's shoulder under the load of the guitar. Attached to the cushioning pad is an internal layer of elastic webbing which stretches over the cushioning pad. In use, under the load of a guitar, this elastic layer absorbs shock, transfers the load of the guitar over the area of the pad and further isolates the motion of the guitar and contributes to the stability of the support pad on the shoulder and the stability of the guitar as it is played.

9 Claims, 7 Drawing Sheets

ERGONOMIC GUITAR STRAP

I. CROSS-REFERENCE TO RELATED APPLICATIONS

None.

II. STATEMENT REGARDING FEDERALLY SPONSORED RESEARCH

None.

III. REFERENCE TO SEQUENCE LISTING

None.

IV. BACKGROUND OF THE INVENTION

The present invention is an improved ergonomic shoulder strap for guitar and other instruments.

Most guitar straps feature nothing more than a two inch wide strap, made of leather or nylon webbing (with no padding) that goes over the shoulder to support the weight of the guitar. A few guitar straps have various types and sizes of pads for the shoulder, but to accommodate different body shapes, sizes, and guitar positions, the pad must be movable along the length of the strap to keep it positioned on top of the shoulder thereby providing comfort. This adjustment is accomplished in some cases, as in the published patent application to Walker, US 2004/0094585, by running the strap through a series of loops over the top of the pad, thus allowing the pad to be moved along the length of the strap. The drawback of this type of pad arrangement is that the load is not applied to the full width of the pad because the portion of the pad that extends out beyond the two inch width of the strap will, due to its softness, flex upward away from the body, thereby not supporting the load which the strap is applying to it.

Sameniego, U.S. Pat. No. 4,858,801, discloses a variation of this pad arrangement wherein, for movement of the pad along the length of the strap, the pad or cushion is detachably connected in one of several different positions on the strap using hook and loop fasteners, such as Velcro stripping. More recently, Kelly discloses in U.S. published patent application no. US 2004/006095 A1, the use of a flexible bladder as a pad. The bladder is inflatable or pre-filled and may be formed integrally with or removably placed onto the strap. A valve in the bladder permits inflation with a gas, a liquid or a gel.

The most common known method of adjustment of the length of a guitar strap is the use of a sliding buckle attached permanently to one end of the strap. The other end of the strap is threaded through the buckle to form a loop in the guitar strap. The buckle is slid relative to the strap end threaded there through to adjust, e.g. shorten or lengthen, the guitar strap. In order to adjust the sliding buckle, the strap has to be taken off the shoulder and off the guitar, the buckle adjusted, then the guitar strap must be reinstalled on the shoulder and the guitar to check for proper adjustment. If further adjustment is required, this process must be repeated until adjustment is to the user's liking.

Another known method of adjusting the length of a guitar strap involves the use of a narrow one inch wide strap that is threaded through a slot in a two inch wide strap, then doubled back and buttoned to itself in one of several positions to change the length of the strap assembly.

Still another known method involves the use of a one piece strap having several button holes in a row on the back end of the strap which allows the back of the guitar to attach in several locations, thus changing the effective strap length and, in turn, the height of the guitar for the player. While these two methods may be easier to adjust than a sliding buckle, they offer very limited adjustability.

There is a need for an improved cushioning guitar strap that is simple, easy to use, and adaptable to a wide range of body shapes, sizes and guitar positions, while providing improved cushioning of the shoulder under the load of the guitar.

V. BRIEF SUMMARY OF THE INVENTION

An ergonomic guitar strap that reduces the load on the shoulder, balances the weight of the guitar front-to-back, absorbs shock during play and isolates motion of the guitar by the use of a cushioning pad that is constructed with a soft, flexible foam layer which conforms to a user's shoulder under the load of the guitar. Attached to the cushioning pad is an internal layer of elastic webbing which stretches over the cushioning pad. In use, under the load of a guitar, this elastic layer absorbs shock, transfers the load of the guitar over the area of the pad and further isolates the motion of the guitar and contributes to the stability of the support pad on the shoulder and the stability of the guitar as it is played. Outer adjustment straps allow for individual adjustment and have quick connect/disconnect ends for attaching to the guitar. The rear connect/disconnect end of the strap can include an integral component "Cord Keeper" for conveniently attaching and detaching the guitar cord to the strap end itself providing greater security and safety by securely holding the cord in a position that places the cord as far as possible from the feet.

VI. BRIEF DESCRIPTION OF THE DRAWINGS

VII. DETAILED DESCRIPTION OF THE INVENTION

Figure 1:
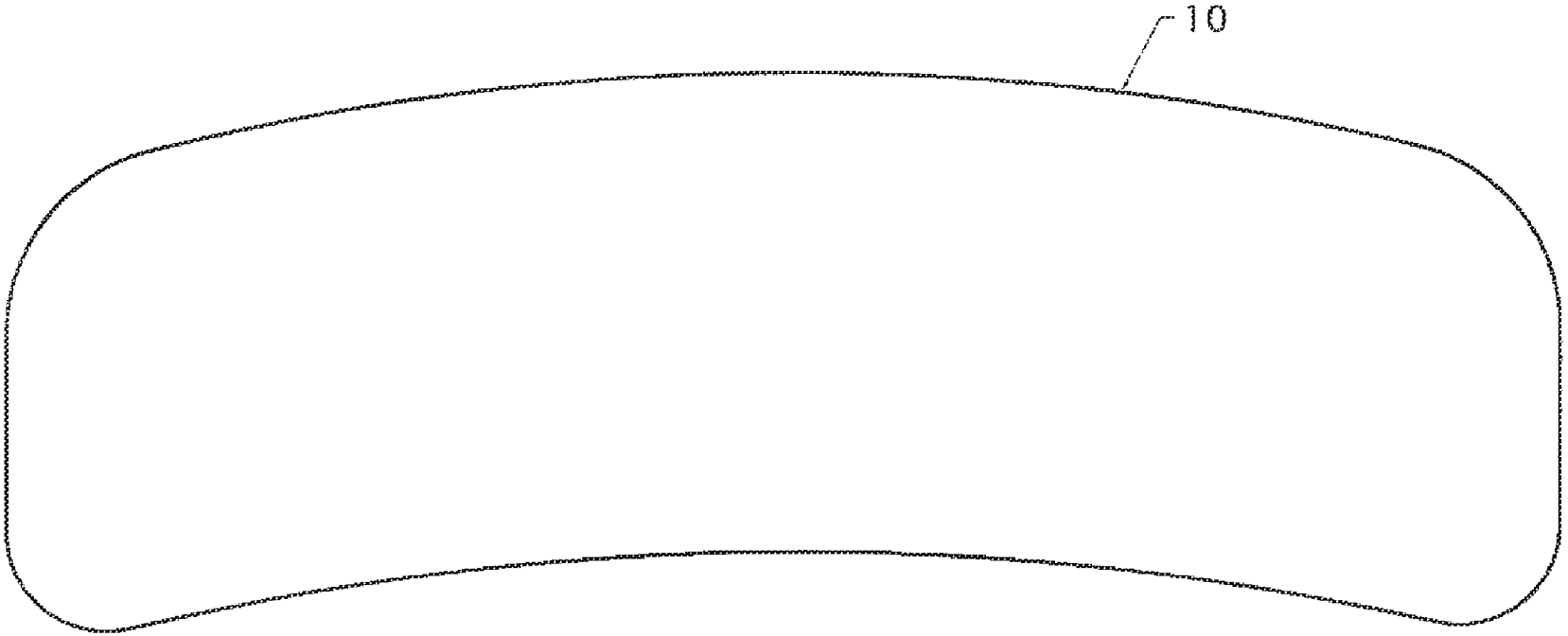
FIG. 1 is a top view of the cushioning pad.

FIG. 1 illustrates the preferred shape of the supporting cushion 10. The cushioning pad 10 is preferably constructed with a soft, flexible foam layer 12, for example ¼" neoprene foam, that conforms to a user's shoulder under the load of the guitar. Attached to the cushioning pad 10 is an internal layer of elastic webbing 14 which stretches through the cushioning pad 10. Under the load of a guitar, this elastic layer absorbs shock, transfers the load of the guitar over the area of the pad, and further isolates the motion of the guitar and contributes to the stability of the support pad on the shoulder and the stability of the guitar as it is played. Preferably, the flexible pad is bottom-clad with suede leather which acts as an outer cover where the pad contacts the shoulder. Also, if the pad is top-clad with polyethylene film, this will act as a lubricating and noise suppressing layer.

Figure 2:
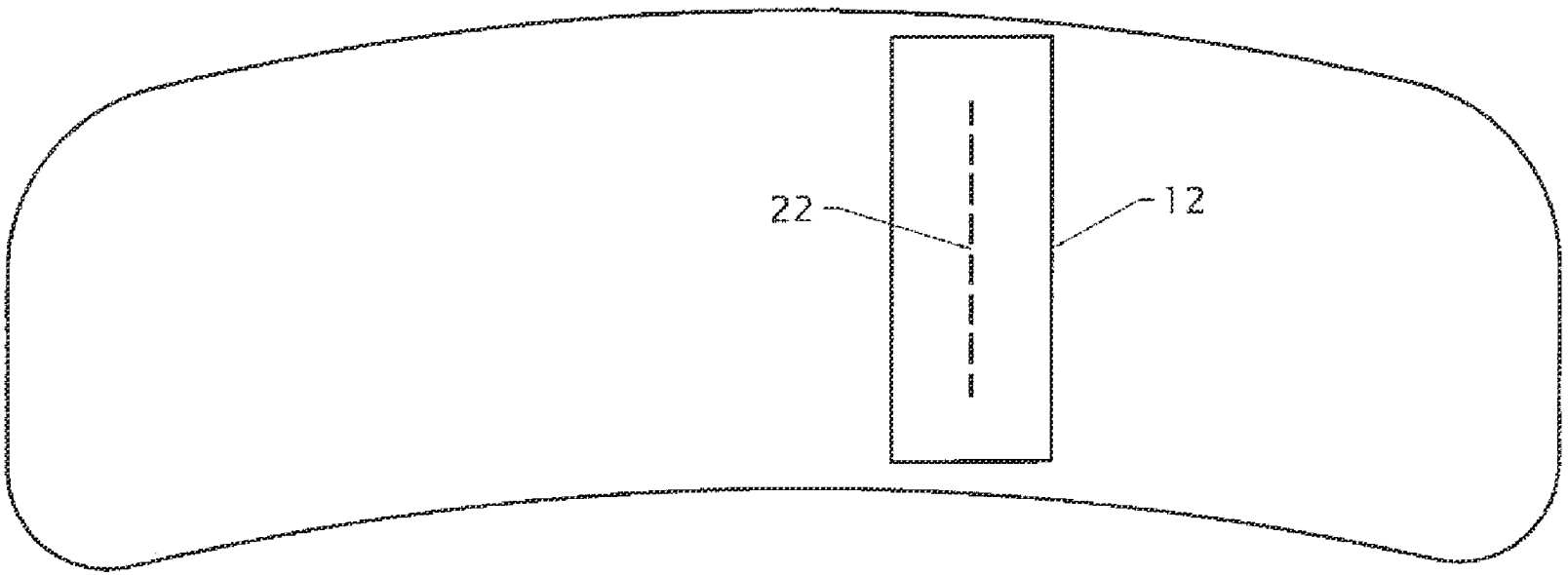
FIG. 2 is a top view of the cushioning pad with nylon reinforcement.

FIG. 2 shows a top view of the invention, wherein the elongated, flexible pad is reinforced on with sewn-in reinforcement. The pad 10 has a top side and a bottom side. At stitch point 22, one or more strips of reinforcing material 12, such as neoprene foam or nylon, are attached to the pad 10. This reinforcing material 12 is preferably sewn into the pad 10 on the top side and the bottom side. The reinforcing material 12 is preferably a sewn-in section of 1000 Denier Nylon that is 1 inch wide and its length is equal to the width of the Pad.

Figure 3:
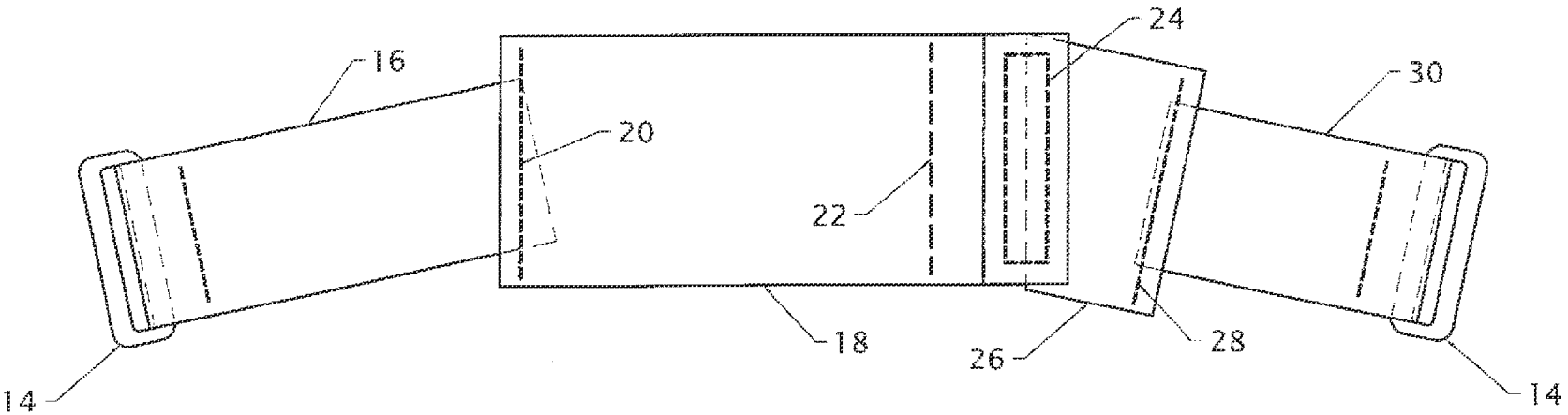
FIG. 3 is a top view of a portion of the guitar strap.

FIG. 3 illustrates a primary internal elastic webbing assembly 18, comprising at least one layer of elastic webbing, wherein the layer(s) of elastic webbing is located internally in the flexible pad 10, between the second layer of felt and the third layer of neoprene foam. The layer(s) of elastic webbing is shown with a front end and a rear end. This figure is oriented such that the components are shown wherein the 'front' end is to the right of the 'rear' end. A secondary internal elastic webbing assembly 26 is shown with a front end and a rear end, wherein the rear end of the secondary internal elastic webbing assembly 26 is attached to the front side of the primary internal elastic webbing assembly 18 at a 10-25 degree clockwise angle at stitch point 24. The primary internal elastic webbing 18 is attached to the pad 10 at stitch point 22.

A front inner-strap assembly 30, primarily composed of inelastic nylon, is shown with a front end and a rear end, wherein the rear of the front strap assembly 30 is attached to the front end of the secondary elastic webbing assembly 26 at stitch point 28, and the front end of the front inner strap assembly 30 is attached to a connector member 14. The rear inner-strap assembly 16, primarily composed of inelastic nylon, is shown with a front end and a rear end, wherein the front end of the rear strap assembly 16 is attached to the rear end of the primary elastic webbing assembly 18 at stitch point 20. The rear end of the rear inner strap assembly 16 is attached to a connector member 14.

Figure 4:
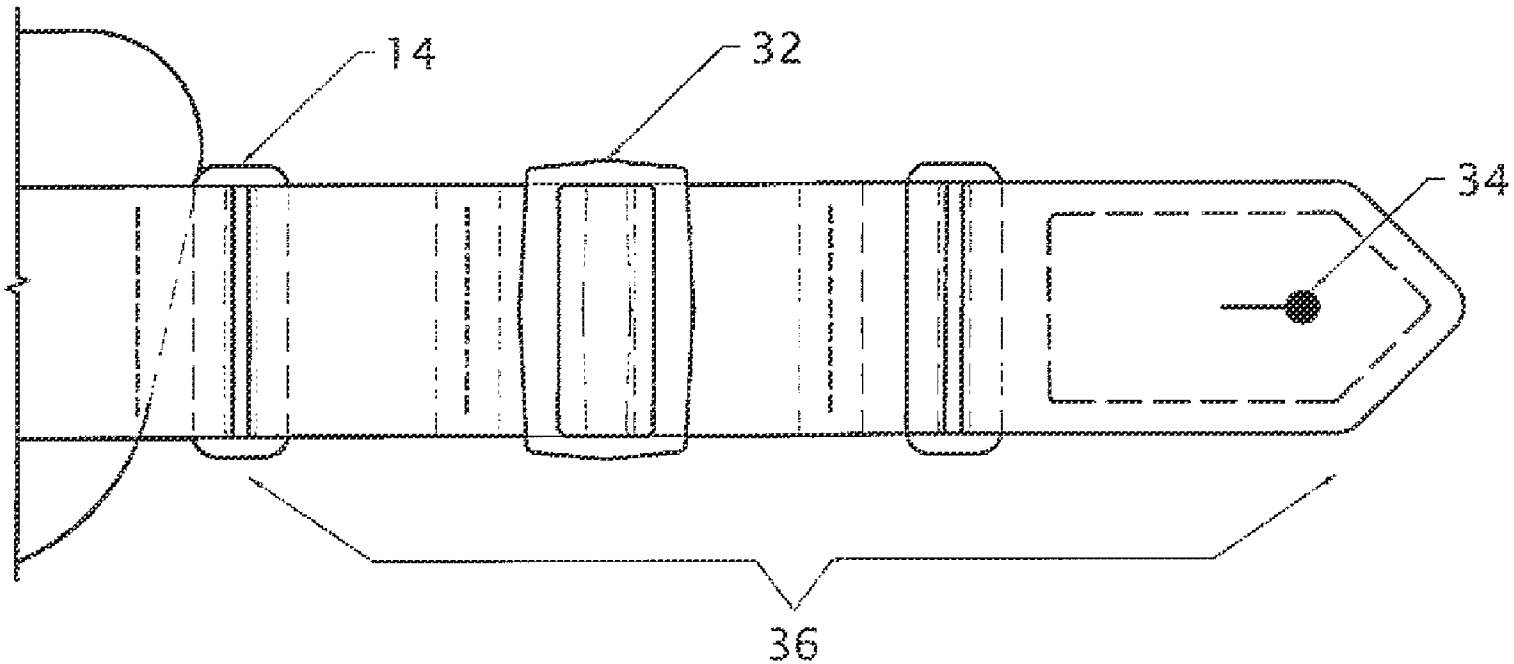
FIG. 4 is a top view of a portion of the guitar strap.

FIG. 4 shows the forward outer adjustment strap assembly 36, having a front end and a rear end, is preferably made from inelastic nylon (or suitable substitute). Again, this figure is oriented such that the components are shown wherein the 'front' ends are to the right of the 'rear' ends. The rear end of the forward outer adjustment strap assembly 36 is attached to the forward end of the inner front strap assembly 30. The forward outer adjustment strap assembly 36 comprises a front portion, which has a guitar attachment member 34 generally located on the front end, and a slide member 32 which allows the user to adjust the length of the forward outer adjustment strap assembly 36. The rear end of the forward outer adjustment strap assembly 36 attaches to the front end of the front inner strap assembly with a connector piece/member 14.

Figure 5:
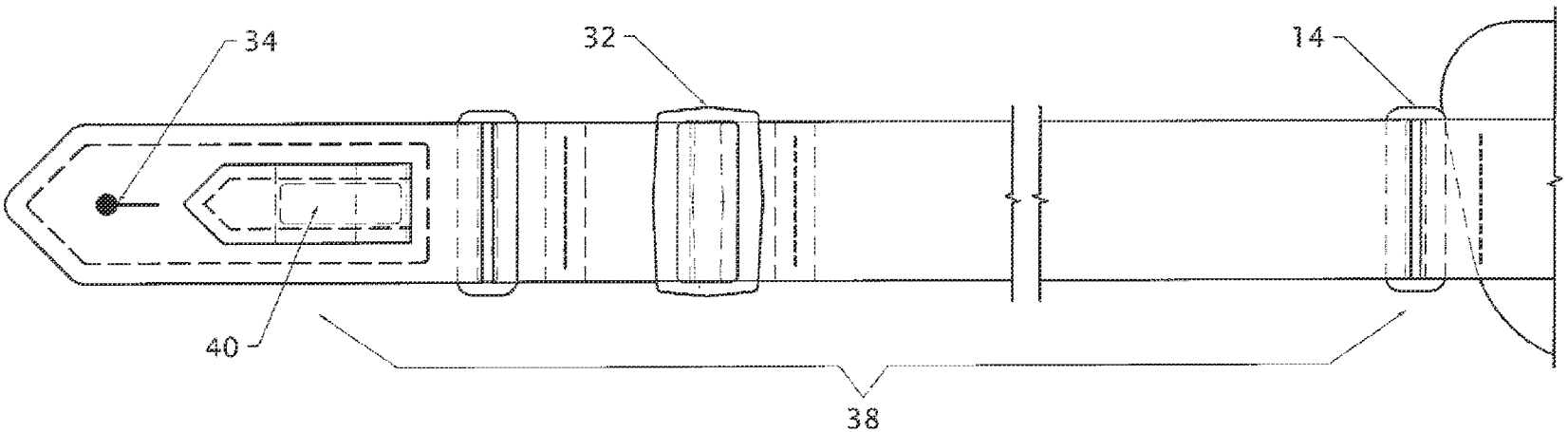
FIG. 5 is a top view of a portion of the guitar strap.

FIG. 5 shows the rear outer adjustment strap assembly 38, having a front end and a rear end. The rear outer adjustment strap assembly 38 is preferably made from inelastic nylon (or suitable substitute). Again, this figure is oriented such that the components are shown wherein the 'front' ends are to the right of the 'rear' ends. The front end of the rear outer adjustment strap assembly 36 is attached to the rear end of the inner rear strap assembly 16 with a connector piece/member 14. The rear outer adjustment strap assembly 38 comprises a rear portion, which has a guitar attachment member 34 generally located on the rear end, and a slide member 32 which allows the user to adjust the length of the rear outer adjustment strap assembly 38.

Figures 7, 7A, 7B:
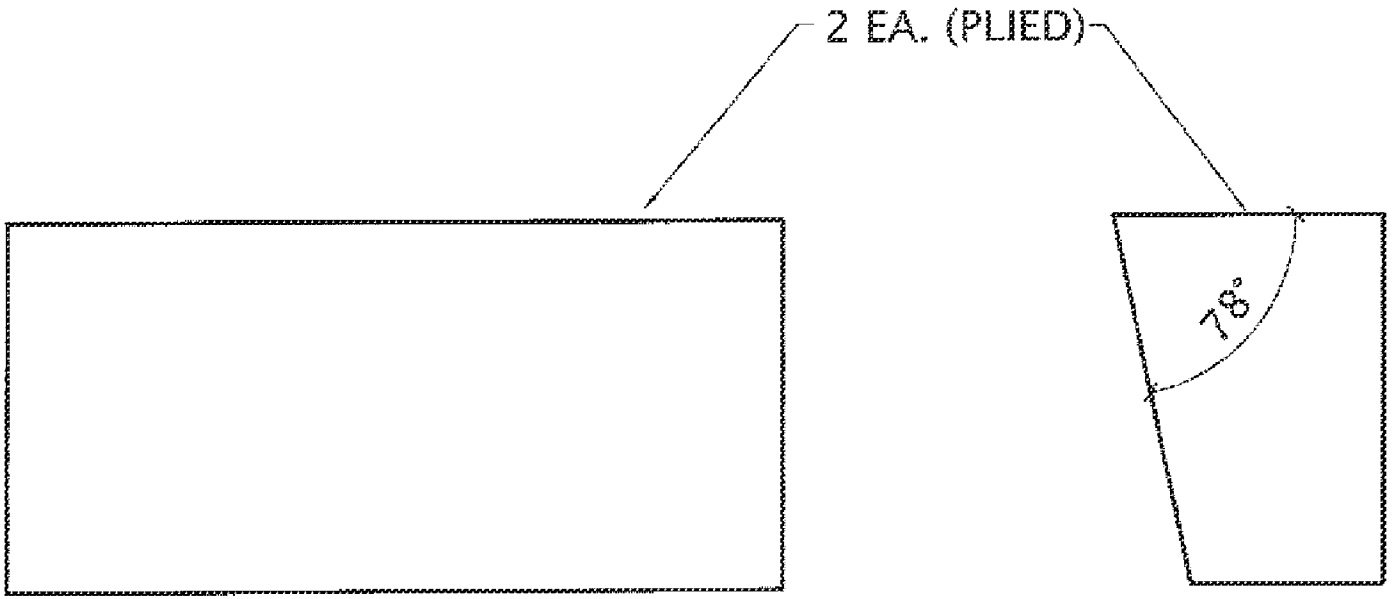
FIG. 7A is a top view of the primary internal elastic webbing assembly.
FIG. 7B is a top view of the secondary internal elastic webbing assembly.

The rear outer adjustment strap assembly 38 can also include a cord organization device 40 (hereinafter referred to as a 'cord keeper'). Preferably, the cord keeper is constructed from 1.5 ounce to 3 ounce weight leather or similar material. The leather is folded, in half, over acetal or 'plastic' loop. The leather is then contact-cemented on its inner surfaces, the two inner surfaces are pressed together, evenly, and sewn as indicated in FIG. 7*a*. The cord keeper 40 is preferably equal to ½ the width of the rear outer adjustment strap assembly 38 and is approximately 6 inches in length. The cord keeper 40 may include a hook and loop fastener attached as follows: On the inner surface of the top edge (the edge that attaches to the rear outer adjustment strap assembly 38, a piece of loop fastener material (equal in width to the cord keeper 40 leather and approximately 1 inch in length) is affixed by gluing and then sewing (FIG. 10*a*). Approximately 2 inches from the inner edge of the loop fastener material (FIG. 10*a*) a correspondingly sized piece of hook fastener material is affixed to the cord keeper 40 leather material by gluing and sewing (FIG. 10*b*). Once the hook and loop fastener material is in place, the outside edge of the integral cord keeper is stitched approximately ⅛ inch around its perimeter (FIG. 10*c*). The cord keeper 40 can be attached to the rear outer adjustment strap assembly 38 at a position approximately 1 inch down from the inner edge of the rear outer adjustment strap assembly 38 (FIG. 7*b*).

The cord keeper 40, or once it is attached to the rear outer adjustment strap assembly 38, the hook and loop sections can be pressed together to create a channel that holds the instrument cord a safer distance away from the body than would otherwise be possible. It further aids in keeping the cord from the player's feet. Furthermore it assists in the prevention of the cord being inadvertently pulled from the instrument and allows for a more convenient access to the cord for insertion and removal.

Figure 6:
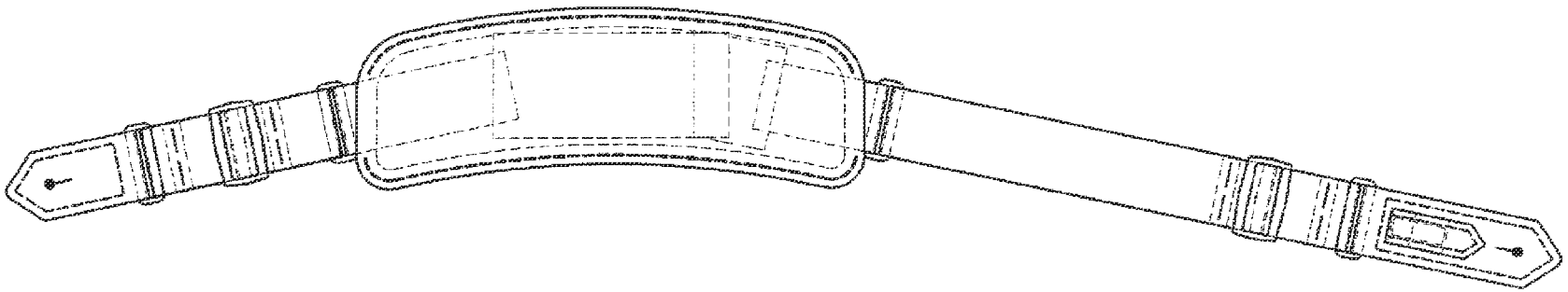
FIG. 6 is a top view of the guitar strap.

FIG. 6 is oriented such that the components are shown wherein the 'front' end are to the left of the 'rear' end. This figure shows a top view of the invention, including all of the major components.

FIG. 7A is a top view of the primary internal elastic webbing assembly 18.

FIG. 7B is a top view of the secondary internal elastic webbing assembly. These figures show the secondary internal elastic webbing assembly 26 with a front end and a rear end, wherein the rear end of the secondary internal elastic webbing assembly 26 is attached to the front side of the primary internal elastic webbing assembly 18 at a 10-25 degree clockwise angle at stitch point 24 (shown here at 12 degrees 90−78=12). Both the primary internal elastic webbing 18 and the secondary internal elastic webbing assembly 26 are preferably 2 ply, giving them strength and durability.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. A guitar strap comprising:

a. An elongated, flexible pad comprising the following layers:
   i. a top layer comprising inelastic nylon;
   ii. a second layer comprising felt, said second layer of felt having a top side and a bottom side;
   iii. a third layer comprising neoprene foam, said third layer of neoprene foam having atop side and a bottom side;
   iv. a polyethylene film coating located on the bottom side of the layer of felt and the top side of the layer of neoprene foam; and
   v. a bottom layer comprising leather (or similar material):

b. a primary internal elastic webbing assembly, comprising at least one layer of elastic webbing, wherein the at least one layer of elastic webbing is located internally in the flexible pad, between the second layer of felt and the third layer of neoprene foam, said at least one layer of elastic webbing having a front end and a rear end;

c. a secondary internal elastic webbing assembly, having a front end and a rear end, wherein;
   i. the rear end of the secondary internal elastic webbing assembly is attached to the front side of the primary internal elastic webbing assembly at a 10-25 degree clockwise angle;

d. A front inner-strap assembly, primarily composed of inelastic nylon, having a front end and a rear end, wherein:
   i. The rear of the front strap assembly is attached to the front end of the secondary elastic webbing assembly;
   ii. The front of the front strap assembly is attached to a connector member;

e. a rear inner-strap assembly, primarily composed of inelastic nylon, having a front end and a rear end, wherein:
   i. The front of the rear strap assembly is attached to the rear end of the primary elastic webbing assembly;
   ii. The rear of the front strap assembly is attached to a connector member;

f. An inelastic forward outer adjustment strap assembly, having a front end and a rear end, wherein the rear end is attached to the front end of the inner strap assembly, comprising:
   i. A front portion, comprising:
      1. a guitar connector piece generally located on the front end;
      2. slide member; and
      3. connect/disconnect end; and
   ii. a rear portion, comprising g. An inelastic rearward outer adjustment strap assembly, having a front end and a rear end, wherein the front end is attached to the rear end of the rearward inner strap assembly, comprising:
   i. a guitar connector piece generally located on the rear end;
   ii. an adjustment slide member generally located between the front end and the rear end; and
      1. a guitar connector piece generally located on the rear end.

2. The guitar strap of claim 1, further comprising a cord keeper located at the rear of the rearward outer adjustment strap assembly.

3. The guitar strap of claim 1, wherein the width of elongated, flexible pad is at least three inches, and at least six inches in length.

4. The guitar strap of claim 1, wherein the width of elongated, flexible pad is at least 1.5 times the width of either the front inner strap assembly, or the rear inner strap assembly.

5. The ergonomic guitar strap according to claim 1, wherein the elongated, flexible pad is bottom-clad with suede leather.

6. The ergonomic guitar strap according to claim 1, wherein the elongated, flexible pad is top-clad with polyethylene film.

7. The ergonomic guitar strap according to claim 1, wherein primary and secondary internal elastic webbing assemblies comprise two sections of two-ply elastic webbing.

8. The ergonomic guitar strap according to claim 1, wherein primary and secondary internal elastic webbing assemblies comprise two-ply Gore elastic at least 2" in width.

9. The ergonomic guitar strap according to claim 1, wherein the primary and secondary internal elastic webbing assemblies comprise nylon webbing of at least 4 inches in width, and no greater than 12 inches in length folded, in-half, through and sewn to a corresponding-sized connecting member.

* * * * *